US007647912B2

(12) United States Patent
Shibata et al.

(10) Patent No.: US 7,647,912 B2
(45) Date of Patent: Jan. 19, 2010

(54) SUPPORTING STRUCTURE AND A SUPPORTING MEMBER FOR A CAMSHAFT

(75) Inventors: Manabu Shibata, Nishio (JP); Katsuhiko Motosugi, Toyota (JP); Masahide Sakurai, Nagoya (JP); Mitsuyoshi Teramura, Nagoya (JP)

(73) Assignee: Otics Corporation, Aichi (JP)

( * ) Notice: Subject to any disclaimer, the term of this patent is extended or adjusted under 35 U.S.C. 154(b) by 25 days.

(21) Appl. No.: 11/987,345

(22) Filed: Nov. 29, 2007

(65) Prior Publication Data

US 2008/0149064 A1 Jun. 26, 2008

(30) Foreign Application Priority Data

Dec. 21, 2006 (JP) ..... 2006-344508

(51) Int. Cl.
*F01L 55/02* (2006.01)

(52) U.S. Cl. ..... 123/193.5; 123/90.27

(58) Field of Classification Search ..... 123/193.3, 123/193.5, 90.27; 74/567
See application file for complete search history.

(56) References Cited

U.S. PATENT DOCUMENTS 3,412,720 A * 11/1968 Binder ..... 123/90.27
3,672,338 A * 6/1972 Yamanouchi ..... 123/90.27
4,441,243 A * 4/1984 Stojek ..... 29/433
4,597,365 A * 7/1986 Madaffer ..... 123/90.6
4,823,747 A * 4/1989 Wagner et al. ..... 123/193.5
5,150,675 A * 9/1992 Murata ..... 123/193.5
5,213,071 A * 5/1993 Iwata et al. ..... 123/90.27
5,605,077 A * 2/1997 Tsunoda et al. ..... 74/567
6,135,082 A * 10/2000 Stromsky et al. ..... 123/196 M
6,408,808 B1 * 6/2002 Yi ..... 123/90.27
6,513,474 B2 * 2/2003 Yoon ..... 123/90.27
7,210,440 B2 * 5/2007 Lawrence et al. ..... 123/90.6
2004/0144349 A1 7/2004 Wampula et al.

(Continued)

FOREIGN PATENT DOCUMENTS

DE 103 31 089 2/2005

(Continued)

OTHER PUBLICATIONS

European Search Report issued May 27, 2009 in connection with corresponding European Application No. 07 02 1949.

*Primary Examiner*—Marguerite J. McMahon
(74) *Attorney, Agent, or Firm*—Wenderoth, Lind & Ponack, L.L.P.

(57) ABSTRACT

In a process of mounting a camshaft 20 to a supporting member 10, a shaft body 21 is firstly inserted into a first bearing hole 13F in the front side of the supporting member 10, before the shaft body 21 is axially moved toward the second bearing hole 13R. In order to get a cam lobe 22 through a concave bearing portion 13M in a semicircular arc shape, rotation of the camshaft 20 enables a cam nose 22*b* to be directed downward, which is opposite from the concave bearing portion 13M. This enables avoiding the interference between the cam nose 22*b* and the concave bearing portion 13M, even when the curvature radius of the concave bearing portion 13M is reduced. Consequently, reduction of the curvature radius of the concave bearing portion 13M achieves the downsizing of the supporting member 10.

14 Claims, 11 Drawing Sheets

U.S. PATENT DOCUMENTS

| | | | | |
|---|---|---|---|---|
| 2005/0120992 | A1 * | 6/2005 | Rieger et al. | 123/193.5 |

FOREIGN PATENT DOCUMENTS

| | | |
|---|---|---|
| FR | 1 217 835 | 5/1960 |
| GB | 2 207 462 | 2/1989 |
| JP | 46-035930 | 12/1971 |
| JP | 61-001814 | 1/1986 |
| JP | 01-249904 | 10/1989 |
| JP | 2006-152837 | 6/2006 |

* cited by examiner

SUPPORTING STRUCTURE AND A SUPPORTING MEMBER FOR A CAMSHAFT

CROSS REFERENCE TO RELATED APPLICATION

This application claims priority from Japanese Patent Application No. 2006-344508 filed Dec. 21, 2006. The entire content of this priority application is incorporated herein by reference.

BACKGROUND OF THE INVENTION

1. Field of the Invention

This invention relates to a supporting structure and a supporting member for a camshaft.

2. Description of the Related Art

In the literature 1 (Japanese Unexamined Patent Publication No. H01-249904), a structure for supporting a camshaft has been disclosed. In this supporting structure for the camshaft, a plurality of cam lobes are rigidly fixed to a shaft body, so that the shaft body is rotatably supported at the both ends of the shaft body, as well as in between adjacent cam lobes by bearings. The bearing is a vertical combination of the semi-circular arc shaped concave portion formed on the top surface of the cam housing and the semi-circular arc shaped concave portion formed on the bottom surface of a cap, which assembles into the cam housing. In other words, a circular bearing hole for supporting the shaft body is composed of vertically united concave portions in a semi-circular arc shape.

SUMMARY OF THE INVENTION

The above-mentioned conventional bearing structure results in the disadvantage that, when the cap is fitted into the cam housing, the center of axle of the semi-circular arc shaped concave portion in the cap side and the center of axle of the semi-circular arc shaped concave portion in the cam housing would be out of alignment due to dimension tolerance and assembly tolerance. As a result, smooth rotation of the camshaft would have been in danger of disturbance.

To address this disadvantage, the camshaft may be supported with a supporting member having a circular bearing hole. In other words, a large-diameter part formed on the circumference of the shaft body is fitted with a circular bearing hole formed in the supporting member. This enables the camshaft to be rotatably supported.

However, not only the shaft body, but also the cam lobe, having an external diameter larger than that of the shaft body, needs to penetrate through the bearing hole. It has been therefore necessary to enlarge the internal diameter of the bearing hole, resulting in size growth of the supporting member.

This invention has been completed based upon the above situation, and its purpose is to downsize the supporting member for supporting a camshaft.

A means for overcoming the problem is the following invention.

The first aspect of the invention is a structure for supporting a camshaft with a supporting member, wherein said camshaft comprises a shaft body of circular cross section and a plurality of nearly-oval-shaped cam lobes provided in the circumference of said shaft body, a large-diameter part for bearing is provided in the circumference of said shaft body, said large-diameter part is provided in the position between a plurality of said cam lobes, the center of said large-diameter part coincides with the center of said shaft body, said large-diameter part has an external diameter of the same size as or larger than that of a cam base in said cam lobe, a pair of bearing holes for rotatably supporting both ends of said shaft body are provided in said supporting member, one bearing hole of said pair of bearing holes is in a circular shape of a size which allows said cam lobe to penetrate there through, a concave bearing portion in a circular arc shape is provided in said supporting member so as to support a pressing load supplied from the side of a valve into said cam lobe, and said large-diameter part is rotatably fitted into said concave bearing portion.

The second aspect of the invention is a supporting member for supporting a camshaft, wherein said camshaft comprises a shaft body of circular cross section and a plurality of nearly-oval-shaped cam lobes provided in the circumference of said shaft body, a large-diameter part for bearing is provided in the circumference of said shaft body, said large-diameter part is provided in the position between a plurality of said cam lobes, the center of said large-diameter part coincides with the center of said shaft body, said large-diameter part has an external diameter of the same size as or larger than that of a cam base in said cam lobe, a pair of bearing holes for rotatably supporting both ends of said shaft body are provided, one bearing hole of said pair of bearing holes is in a circular shape of a size which allows said cam lobe to penetrate there through, a concave bearing portion in a circular arc shape is provided so as to support a pressing load supplied from the side of a valve into said cam lobe, and said large-diameter part is rotatably fitted into said concave bearing portion.

These and other objects, features and advantages of the present invention will become more apparent upon reading of the following detailed description along with the accompanied drawings.

DETAILED DESCRIPTION OF THE PREFERRED EMBODIMENTS

Figure 1:
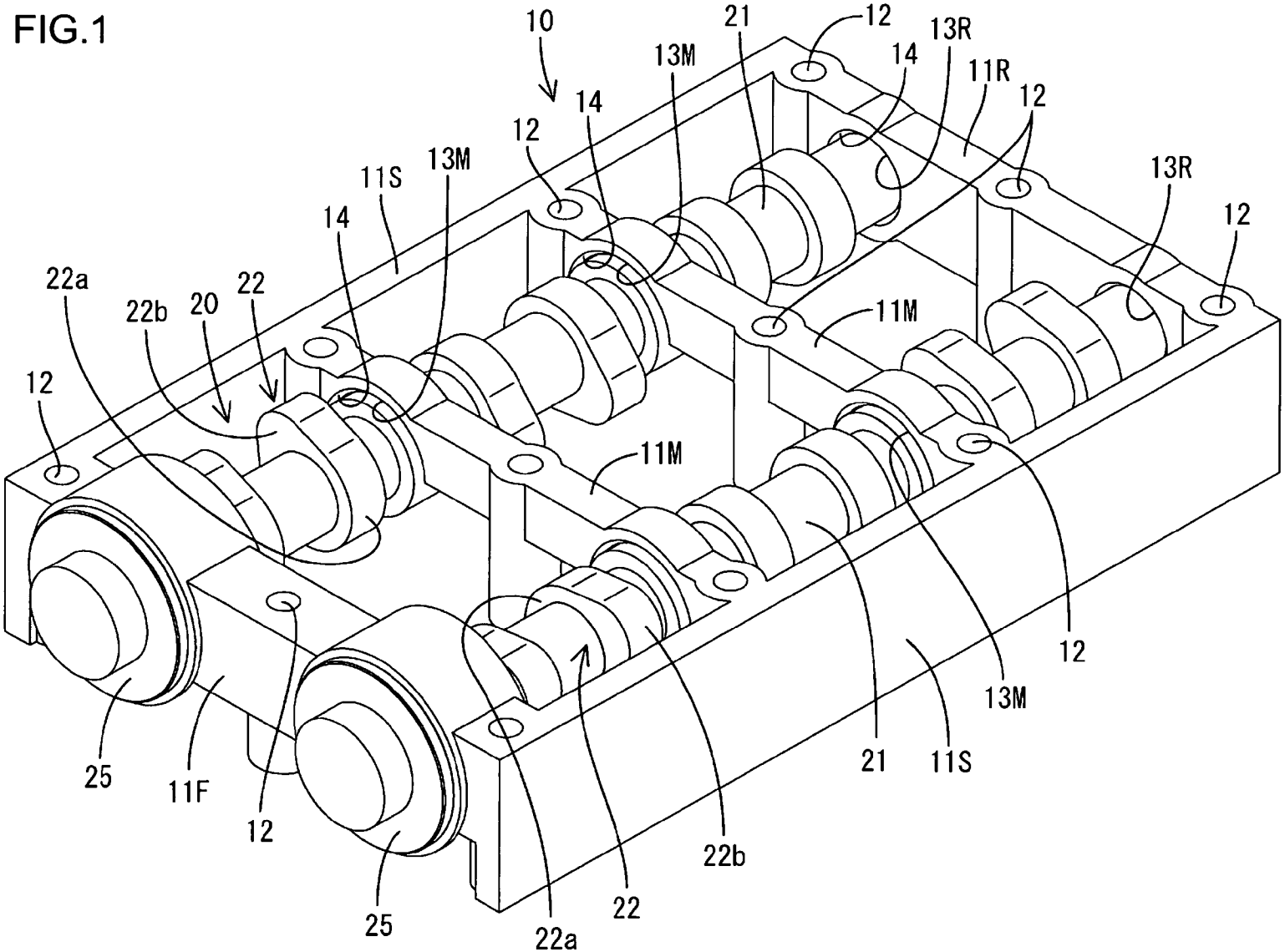
FIG. 1 shows a perspective view of Embodiment 1.
Figure 2:
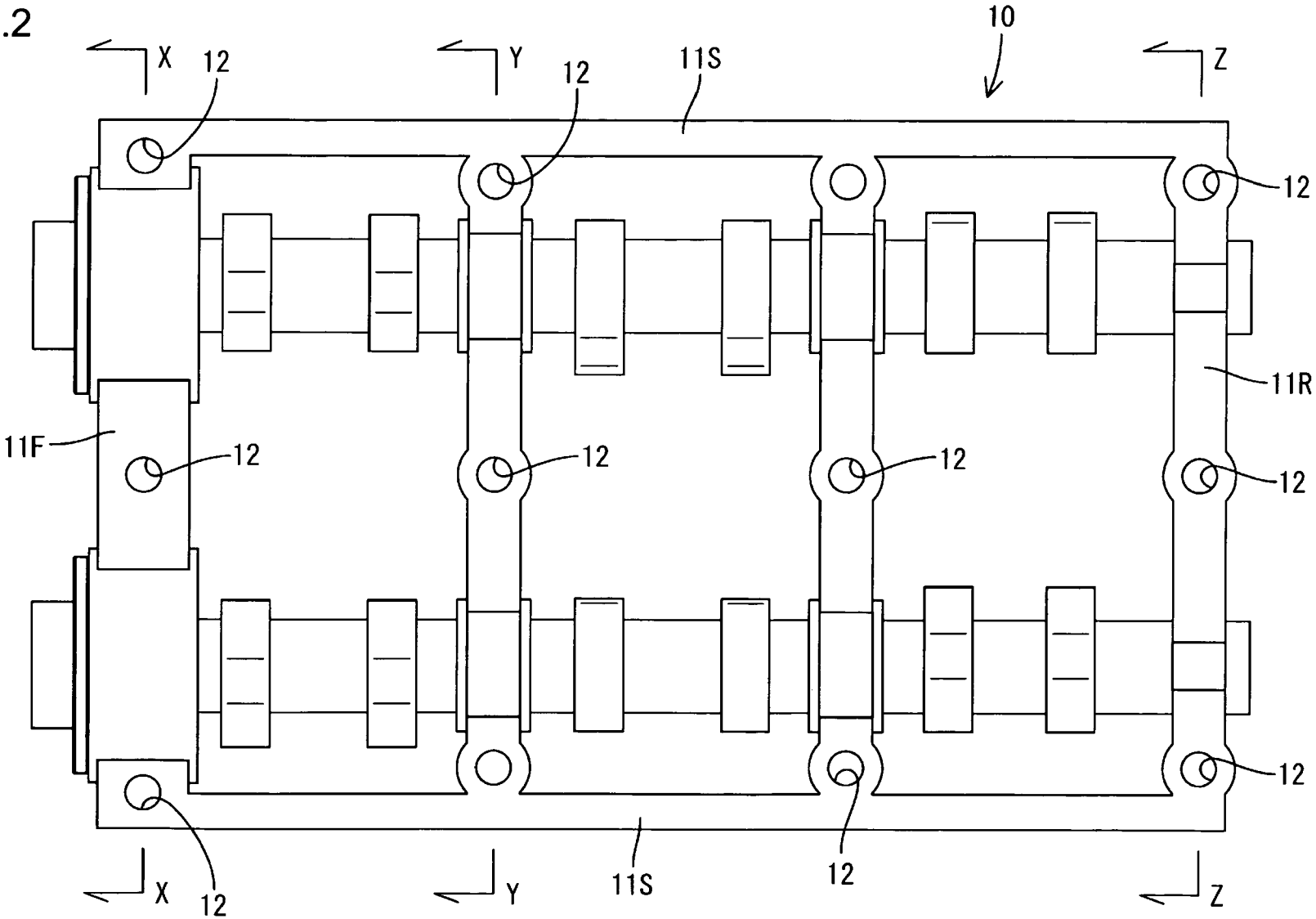
FIG. 2 shows a plain view of Embodiment 1.
Figure 3:
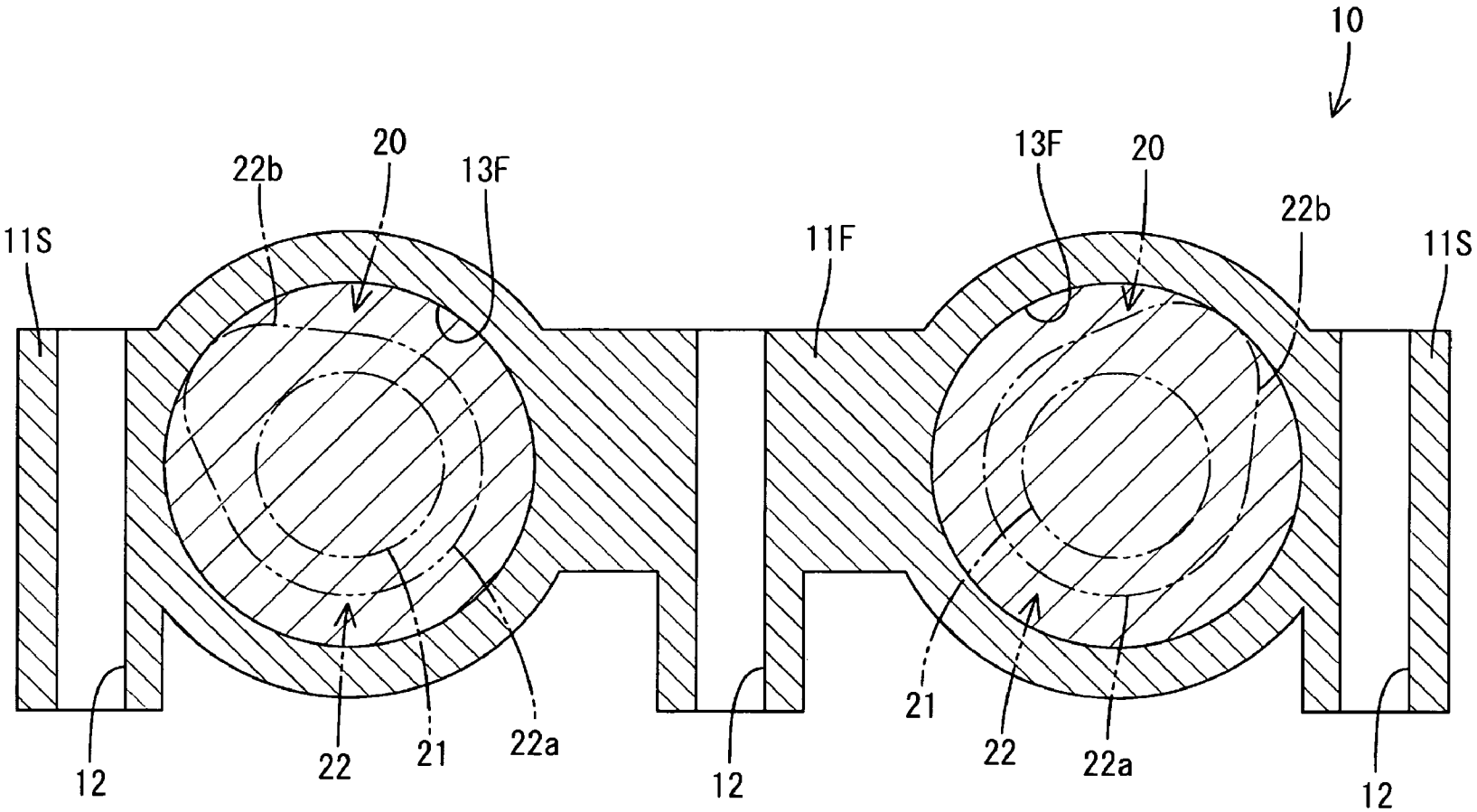
FIG. 3 shows a cross-sectional view along the line X-X in FIG. 2.
Figure 4:
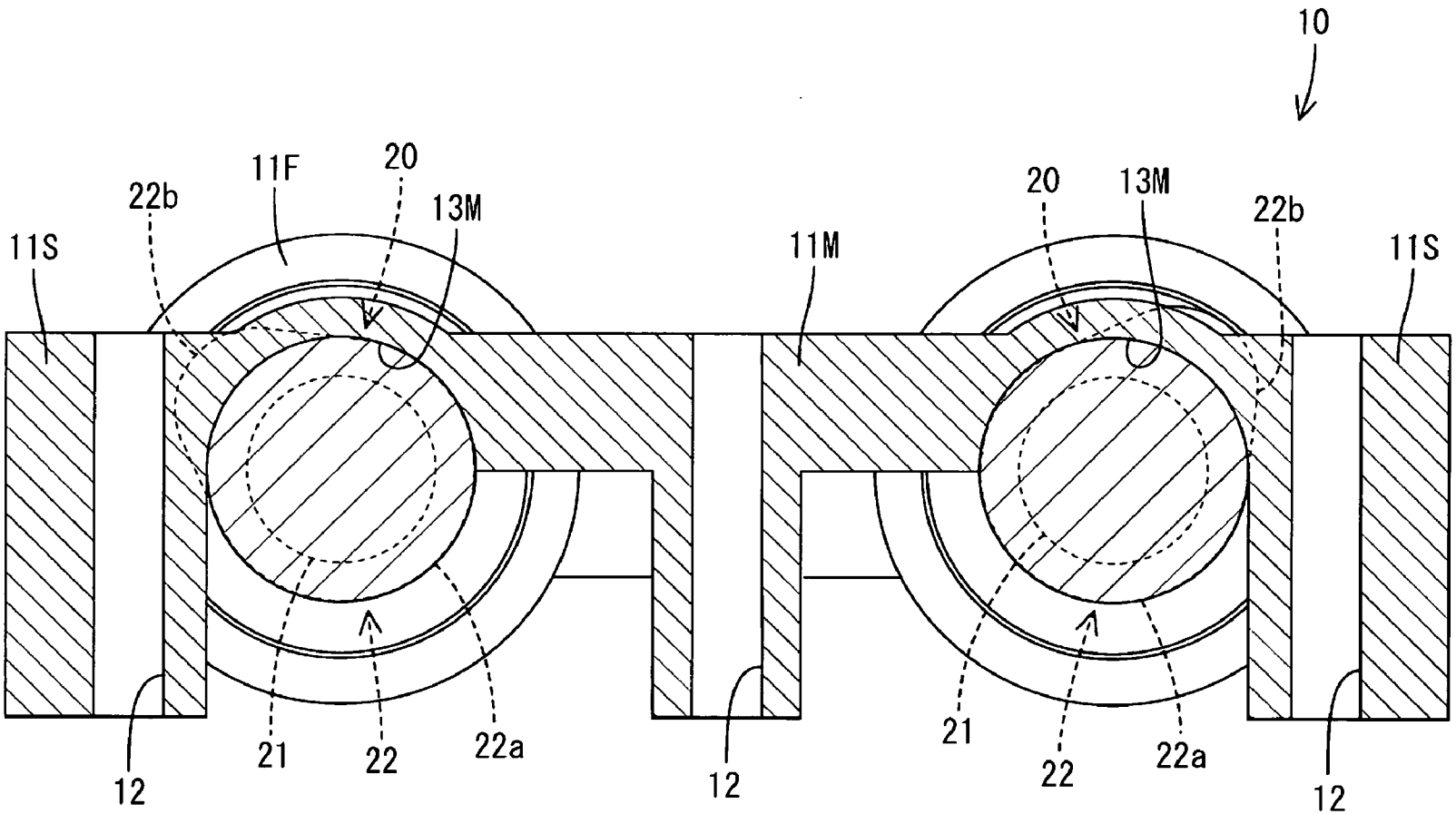
FIG. 4 shows a cross-sectional view along the line Y-Y in FIG. 2.
Figure 5:
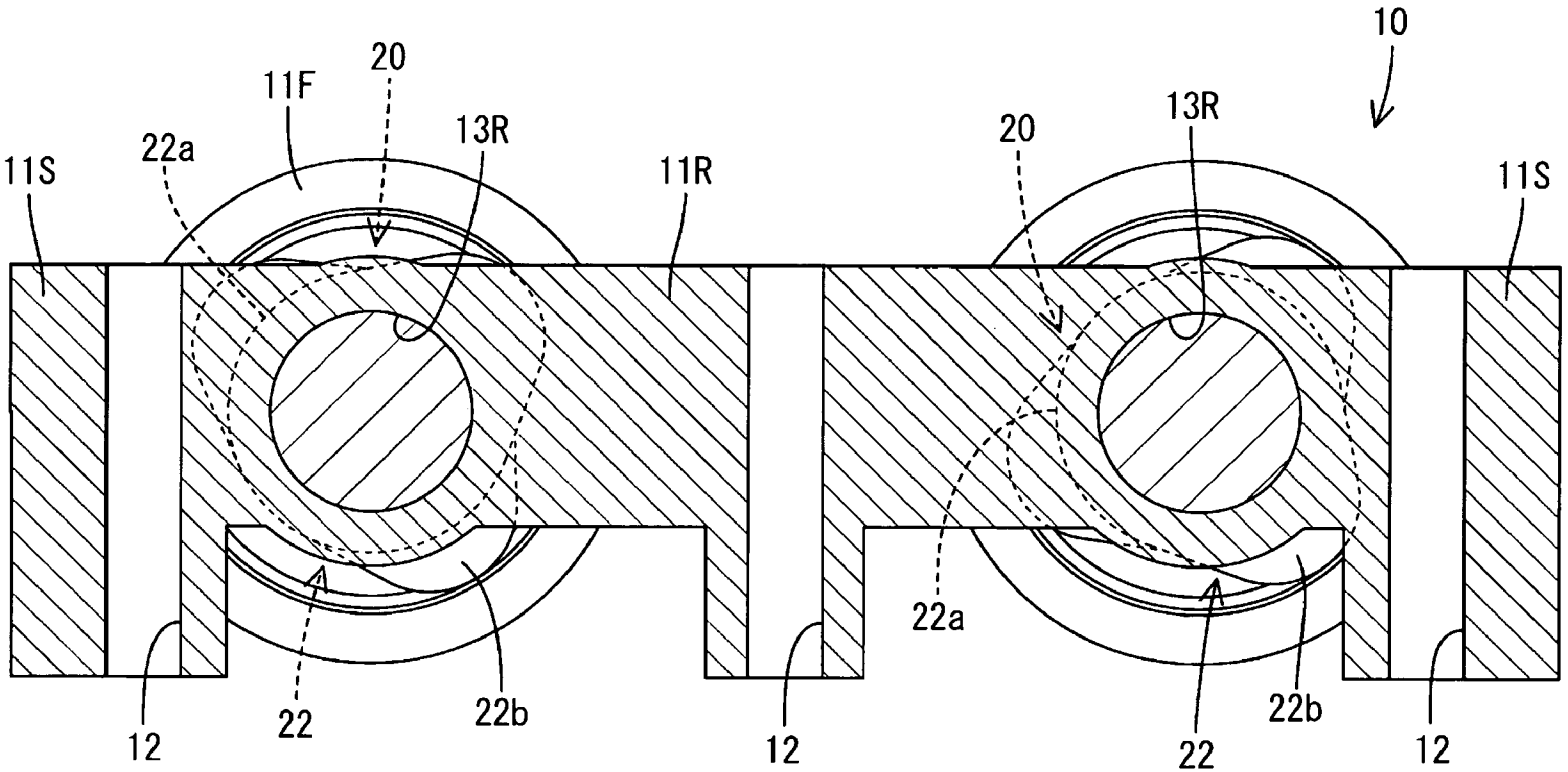
FIG. 5 shows a cross-sectional view along the line Z-Z in FIG. 2.

With embodiments of the present invention described hereinafter with reference to the accompanying drawings, it is to be understood that the invention is not limited to those precise embodiments, and that various changes and modifications may be effected therein by one skilled in the art without departing from the scope or spirit of the invention as defined in the appended claims.

According to this invention, a pair of bearing holes are formed in a supporting member. One bearing hole of said pair of bearing holes is formed in a size which allows a cam lobe to penetrate there through. In a process of assembling a camshaft into the supporting member, the camshaft penetrates through one bearing hole, and at the same time, axially moves toward the other bearing hole. Here, the cam lobe penetrates through the concave bearing portion.

When the camshaft needs to be axially moved, the camshaft can be rotated. This enables a cam nose in the cam lobe to turn toward the opposite side of the concave bearing portion. As a result, the contact between the concave bearing portion and the cam nose can be avoided.

According to the present invention, in a process of axially moving the camshaft, the contact between the cam nose and the concave bearing portion can be avoided, even when the curvature radius of the concave bearing portion is reduced. Consequently, reducing the curvature radius of the concave bearing portion can be achieved, thereby downsizing the supporting member.

Embodiment 1

In what follows, Embodiment 1 of the present invention is described as referring to FIGS. 1 to 8.

A supporting member 10 is a single part made of metallic material such as aluminum alloy. The supporting member 10 is comprised of a pair of right and left side frames 11S, a front frame 11F connecting the side frames 11S at their front ends, a rear frame 11R connecting the side frames 11S at their rear ends, and a pair of front and rear middle frames 11M anteroposteriorly dividing the area surrounded by the side frames 11S, the front frame 11F, and the rear frame 11R into three.

In each of the front frame 11F, the rear frame 11R, and the pair of middle frames 11M, a bolt-hole 12 is formed as penetrating vertically there through. The bolt-holes 12 are formed in three places in each of the frames: at both right and left ends, as well as at the center in horizontal direction.

The supporting member 10 is fixed onto the top surface of a cylinder head not shown. The supporting member 10 is fixed onto the top surface of the cylinder head with a bolt (not shown) inserted into the bolt-hole 12.

A first bearing hole 13F penetrating anteroposteriorly through the interval portion between the adjacent bolt-holes 12 is formed in the front frame 11F. A second bearing hole 13R penetrating anteroposteriorly through the interval portion between the adjacent bolt-holes 12 is formed in the rear frame 11R. The first bearing hole 13F, as well as the second bearing hole 13R are circular. The first bearing holes 13F, as well as the second bearing holes 13R are formed respectively in pair in the right and the left.

The first bearing hole 13F and the second bearing hole 13R arranged in the right side are concentrically aligned.

The first bearing hole 13F and the second bearing hole 13R arranged in the left side are concentrically aligned.

The internal diameter of the first bearing hole 13F formed in the front frame 11F is larger than that of the second bearing hole 13R formed in the rear frame 11R.

The size of the internal diameter of the first bearing hole 13F is what allows a cam lobe 22 to penetrate there through.

A first large-diameter part 23 to be later described fits into the first bearing hole 13F. This allows the first large-diameter part 23 to be smoothly and rotatably supported without rattling in a radial direction.

A shaft body 21 of a camshaft 20 fits into the second bearing hole 13R. This enables the shaft body 21 to be smoothly and rotatably supported without rattling in a radial direction.

At the opening edge of both the first bearing hole 13F and the second bearing hole 13R, a guide surface 14 in a tapered shape is formed.

The anteroposterior thickness of the front frame 11F is greater than that of the rear frame 11R.

The concave bearing portion 13M is respectively formed in two middle frames 11M aligned anteroposteriorly.

The concave bearing portions 13M are respectively formed in a pair in the right and the left.

The concave bearing portion 13M has a shape with a semicircular cutout in its bottom surface.

The central axis of the concave bearing portion 13M in a circular arc shape coincides with that of the first bearing hole 13F and the second bearing hole 13R.

The curvature radius of the front side concave bearing portion 13M is identical with the radius of a second large-diameter part 24 to be later described. Also, the curvature radius of the rear side concave bearing portion 13M is also identical with the radius of the second large-diameter part 24.

The second large-diameter part 24 corresponds to the "large-diameter part for bearing" in the present invention.

When the cam lobe 22 contacts with the upper end of an engine valve not shown, the cam lobe 22 receives upward pressing load (reaction force) from the engine valve. This reaction force is received with the concave bearing portion 13M.

The inner circumference surface of the concave bearing portion 13M faces downward (valve side). This enables the concave bearing portions 13M to receive the reaction force supplied from the engine valve side.

At the opening edge of the concave bearing portion 13M, the guide surface 14 in a tapered shape is formed as similar to the first bearing hole 13F and the second bearing hole 13R.

The front frame 11F, the middle frames 11M, and the rear frame 11R configures a bearing means (bearing part).

Two camshafts 20 of circular cross-section are mounted in the supporting member 10.

Figure 6:
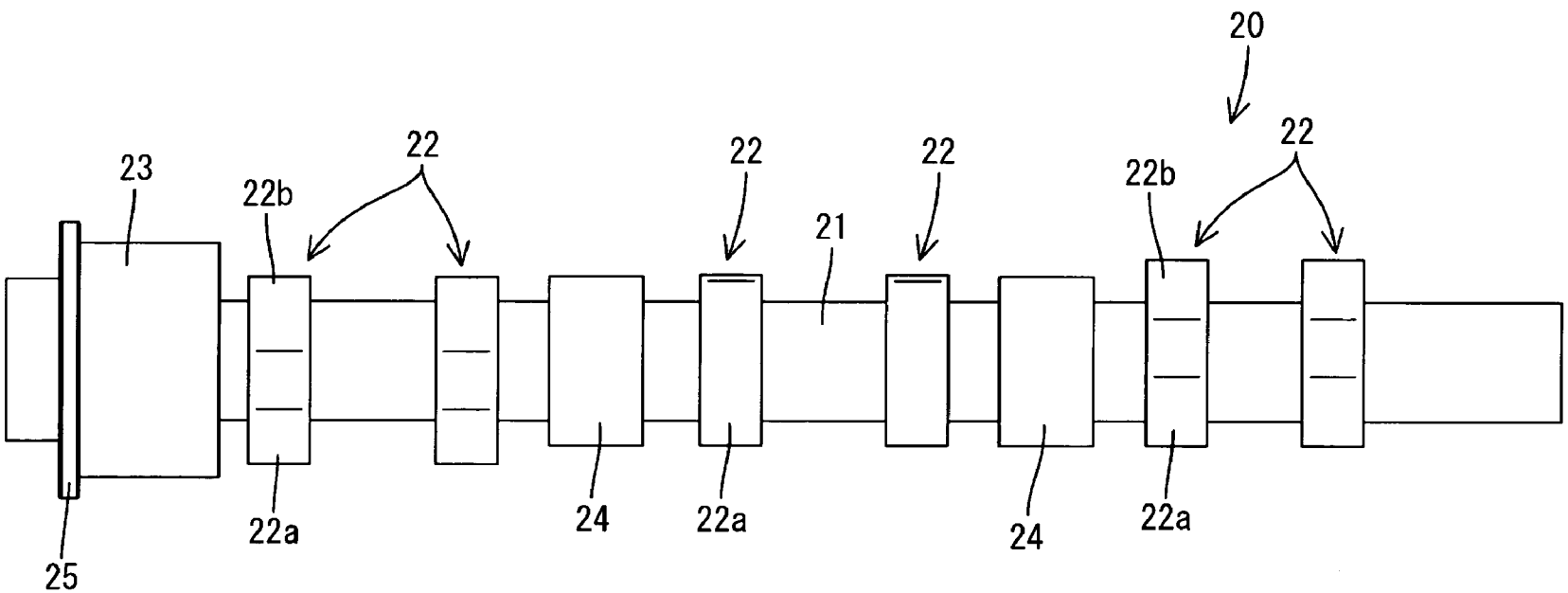
FIG. 6 shows a plain view of a camshaft.
Figure 7:
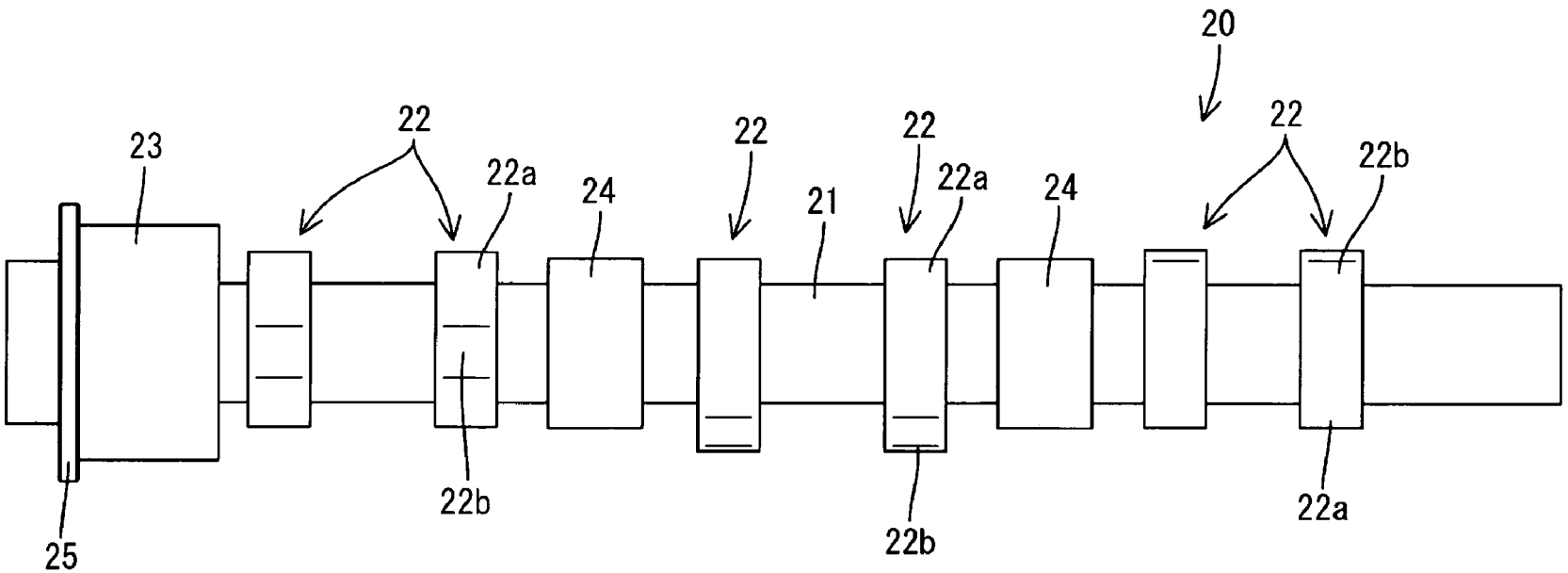
FIG. 7 shows a side view of a camshaft.
Figure 8:
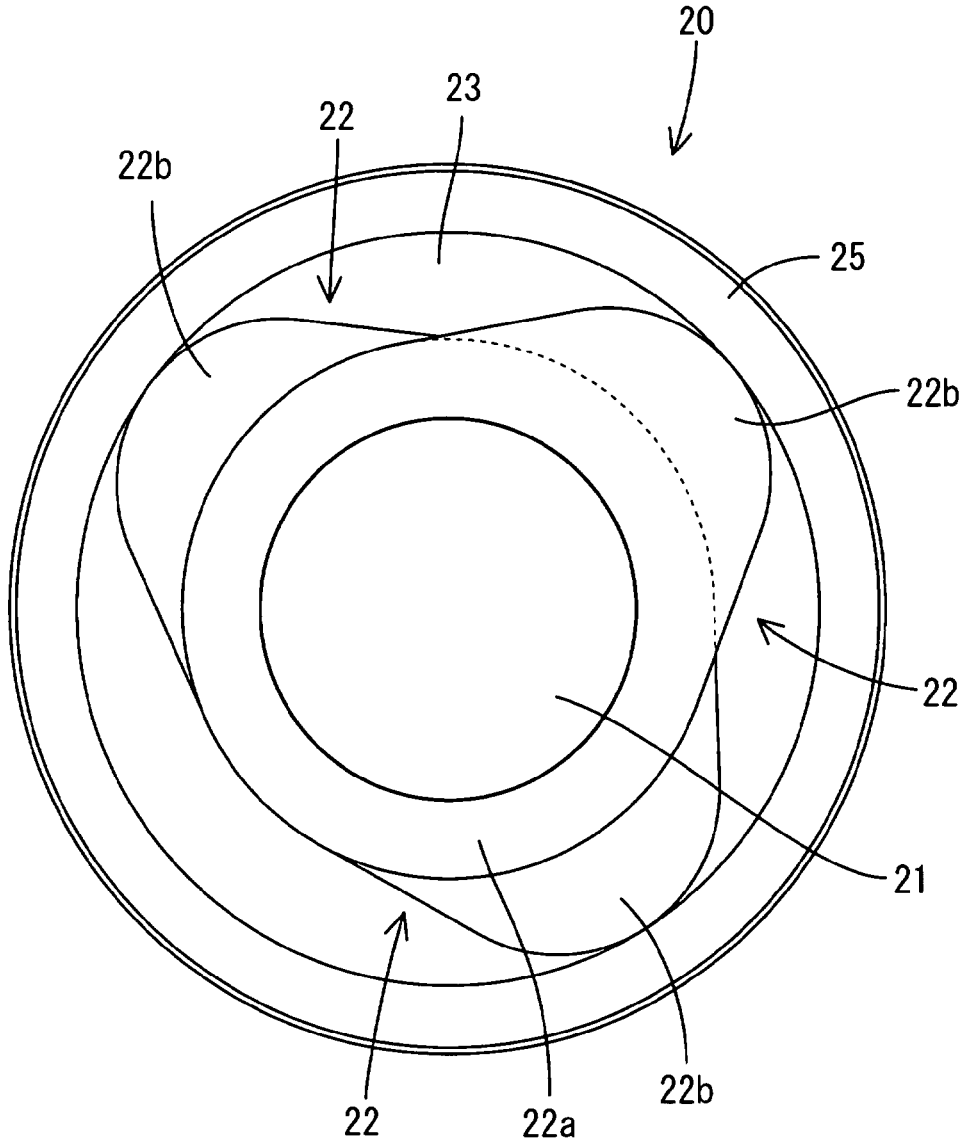
FIG. 8 shows a back view of a camshaft.

Each camshaft 20 is comprised of one shaft body 21, the first large-diameter part 23 integrally formed on the front end of the shaft body 21, two second large-diameter parts 24 aligned anteroposteriorly and both formed behind the first large-diameter part 23, and six nearly-oval-shaped cam lobes 22 integrally formed with the shaft body 21 (See FIG. 6).

The first large-diameter part 23 has a circular shape, and is concentric with the shaft body 21. The radius of the first large-diameter part 23 is identical with or greater than the maximum distance from the center of the axis of the cam lobe 22 to the circumferential surface (i.e. the distance from the center of the axis of the cam lobe 22 to the circumference of a cam nose 22*b*).

A flange-shaped stopper 25, which has a circular shape and is concentric with the first large-diameter part 23, is formed in the circumference of the first large-diameter part 23.

Similar to the first large-diameter part 23, the second large-diameter part 24 has a circular shape, and is concentric with the shaft body 21. The radius of the second large-diameter part 24 is identical with or slightly greater than the distance from the center of the axis of the cam lobe 22 to the circumference of the cam base 22*a*.

The cam lobe 22 has a well-known shape, which is nearly-oval as a whole.

The cam lobe 22 is comprised of the cam base 22*a* having a circular arc shape and being concentric with the shaft body 21, and the cam nose 22*b* with its distance from the center to the circumferential surface larger than the cam base 22*a*.

Two cam lobes 22 in the front among the six are arranged between the first large-diameter part 23 and the front-side second large-diameter part 24.

Two cam lobes 22 positioned in the center in an anteroposterior direction are arranged between the front-side second large-diameter part 24 and the rear-side second large-diameter part 24.

Two cam lobes 22 positioned in the rear are arranged behind the rear-side second large-diameter part 24 and forward of the rear end of the shaft body 21.

The rear end of the shaft body 21 fits into the second bearing hole 13R.

In a process of mounting the camshaft 20 to the supporting member 10, the shaft body 21 is firstly inserted into the first bearing hole 13F in the front side of the supporting member 10, before the shaft body 21 is axially moved toward the second bearing hole 13R.

In order to get the cam lobe 22 through the concave bearing portion 13M, rotation of the camshaft 20 enables the cam nose 22*b* to be directed downward, which is opposite from the concave bearing portion 13M. This enables the contact between the cam lobe 22 and the middle frame 11M (the concave bearing portion 13M) to be avoided.

As described above, when the camshaft 20 is mounted to the supporting member 10, rotation of the camshaft 20 enables appropriately changing the direction of the cam nose 22*b*.

The rear end of the first large-diameter part 23 begins to fit into the first bearing hole 13F at the moment when the camshaft 20 reaches to the predefined assembling position. Subsequently, the rear end of the shaft body 21 begins to fit into the second bearing hole 13R. Furthermore, two second large-diameter part 24 begins to fit with the concave bearing portions 13M. Then, when the camshaft 20 reaches to the predefined assembling position, the stopper 25 contacts with the front end surface of the front frame 11F. This restricts the further movement of the camshaft 20.

Assembling the camshaft 20 into the supporting member 10 enables the large-diameter part 23 to fit into the first bearing hole 13F. This enables the camshaft 20 to be smoothly and rotatably supported without rattling in a radial direction.

Assembling the camshaft 20 into the supporting member 10 enables two second large-diameter parts 24 to respectively fit with the corresponding concave bearing portions 13M. This enables the camshaft 20 to be smoothly and rotatably supported without rattling in a radial direction.

Assembling the camshaft 20 into the supporting member 10 enables the rear end of the shaft body 21 to fit into the second bearing hole 13R. This enables the camshaft 20 to be smoothly and rotatably supported without rattling in a radial direction.

With the above, the assembly of the camshaft 20 into the supporting member 10 is completed.

A supporting structure, as well as a supporting member for a camshaft according to the present embodiment bring about the working and the effect as follows.

In order to get the cam lobe 22 through the concave bearing portion 13M, rotation of the camshaft 20 enables the cam nose 22*b* to be directed downward, which is opposite from the concave bearing portion 13M. This enables the contact between the concave bearing portion 13M and the cam nose 22*b* to be avoided, even when the curvature radius of the concave bearing portion 13M is reduced.

Consequently, reducing the curvature radius of the concave bearing portion 13M can be achieved, thereby downsizing the supporting member 10.

Embodiment 2

Figure 9:
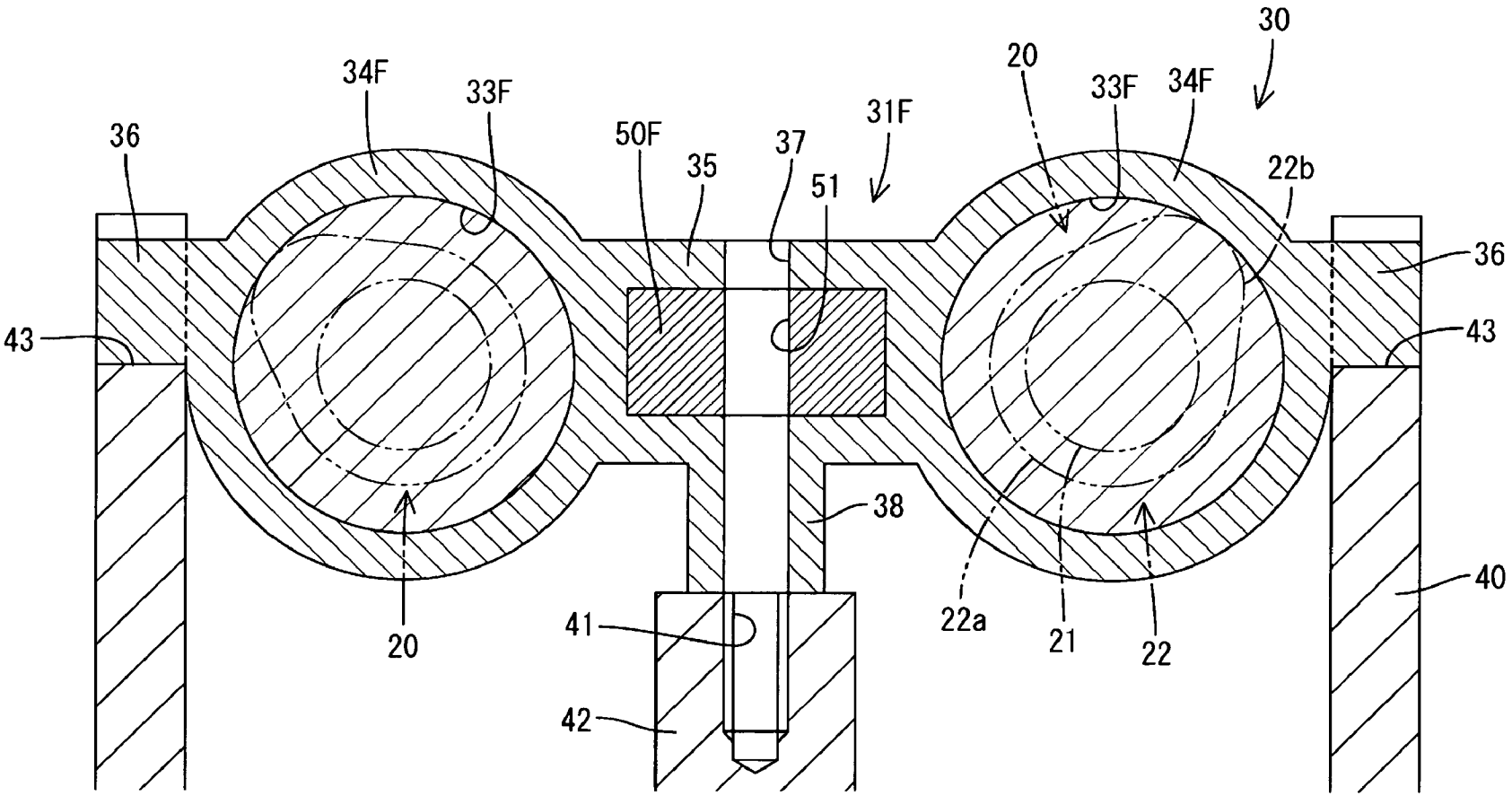
FIG. 9 shows a cross-sectional view of a bearing structure for supporting the front end of a camshaft according to Embodiment 2.
Figure 10:
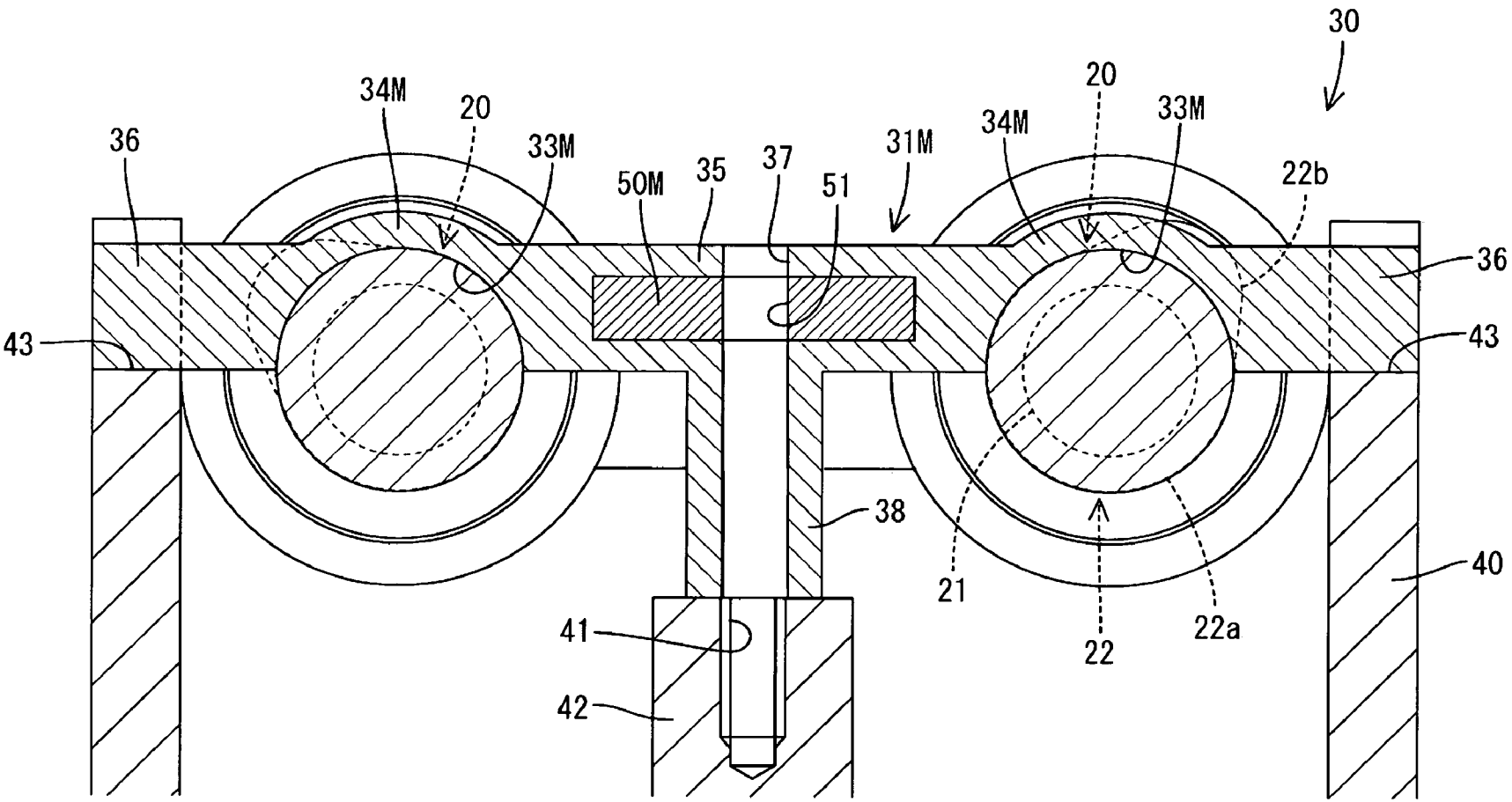
FIG. 10 shows a cross-sectional view of a bearing structure for supporting the central part in an anteroposterior direction of a camshaft.
Figure 11:
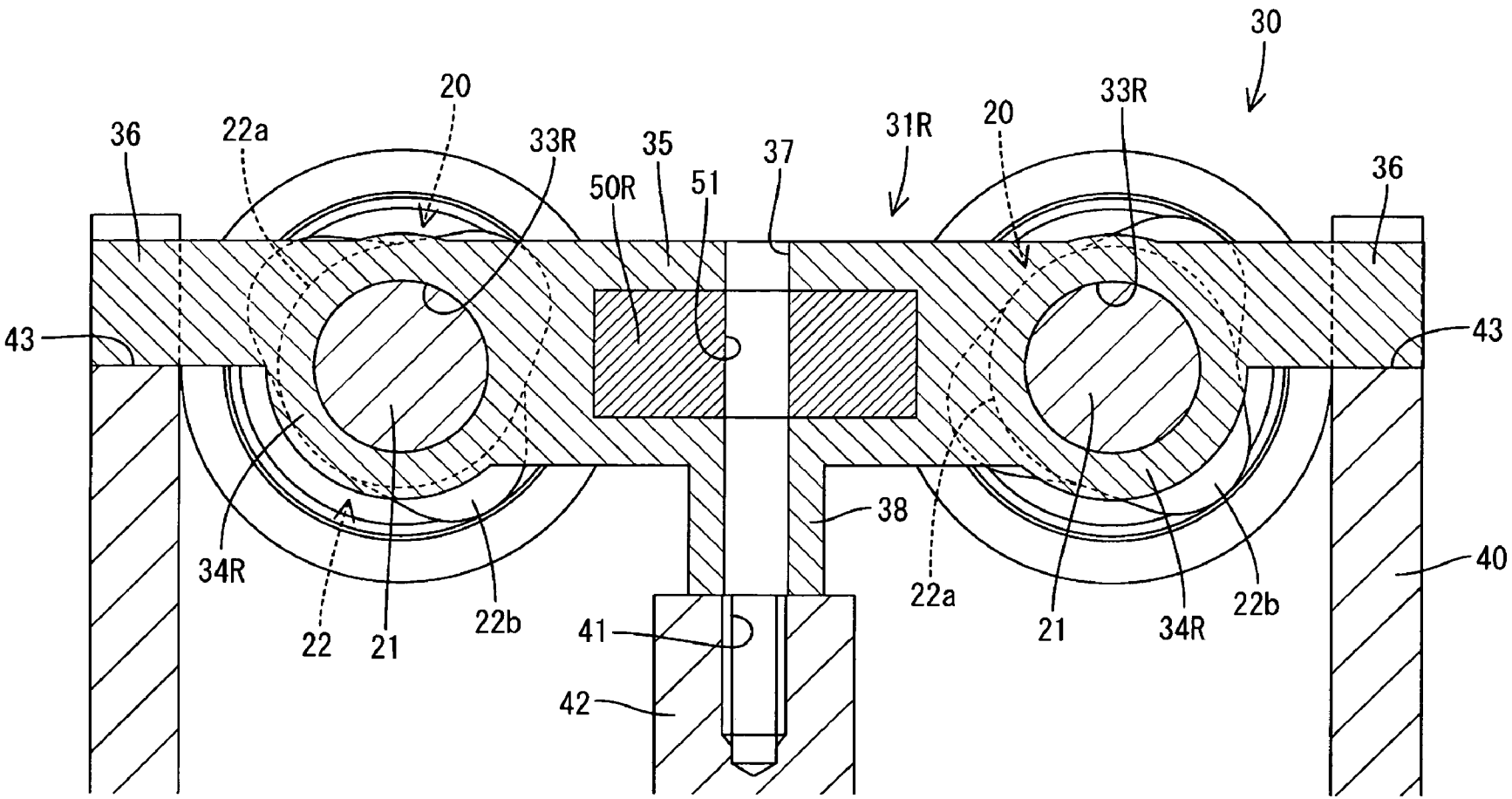
FIG. 11 shows a cross-sectional view of a bearing structure for supporting the rear end of a camshaft.

In what follows, Embodiment 2 of the present invention is described as referring now to FIGS. 9 to 11.

In Embodiment 2, a supporting member 30 is configured differently from what in the above-mentioned Embodiment 1. Since the other structures are the same as those in Embodiment 1, the same reference numbers are allotted to those of the corresponding structures, omitting descriptions on constitution, working, and effect.

While the supporting member 10 in Embodiment 1 is a single part, the supporting member 30 in Embodiment 2 is comprised of four bearing bodies 31F, 31M, and 31R. The supporting member 30 supports two camshaft 20. Four bearing bodies 31F, 31M, and 31R are aligned anteroposteriorly in parallel, and fixed to a cylinder head 40.

Four bearing bodies 31F, 31M, and 31R are made of aluminum alloy.

The bearing body 31F placed in the very front corresponds to the front frame 11F in Embodiment 1. The bearing body 31R placed in the very rear corresponds to the rear frame 11R in Embodiment 1. The remaining two middle bearing bodies 31M correspond to the middle frames 11M in Embodiment 1.

The bearing body 31F in the front is comprised of a pair of first bearing holes 33F in the right and left, a pair of first bearing parts 34F in the right and left, a connecting part 35 connecting the pair of first bearing parts 34F, and an ear 36 protruding from the circumference of the pair of first bearing parts 34F to the opposite direction of the connecting part 35 (see FIG. 9). The first bearing hole 33F has an identical shape with the first bearing hole 13F in Embodiment 1. The first bearing part 34F is cylindrical, being concentric with the first bearing hole 33F. A bolt-hole 37 is formed in the connecting part 35, penetrating vertically there through.

The bearing body 31R in the rear is comprised of a pair of second bearing holes 33R in the right and left, a pair of second bearing parts 34R in the right and left, a connecting part 35 connecting the pair of second bearing parts 34R, and an ear 36 protruding from the circumference of the pair of second bearing parts 34R to the opposite direction of the connecting part 35 (see FIG. 11). The second bearing hole 33R has an identical shape with the second bearing hole 13R in Embodiment 1. The second bearing part 34R is cylindrical, being concentric with the second bearing hole 33R. A bolt-hole 37 is formed in the connecting part 35, penetrating vertically there through.

The bearing body 31M in the middle is comprised of a pair of concave bearing portions 33M in the right and left, a pair of third bearing parts 34M in the right and left, a connecting part 35 connecting the pair of third bearing parts 34M, and an ear 36 protruding from the circumference of the pair of third bearing parts 34M to the opposite direction of the connecting part 35 (see FIG. 10). The concave bearing portion 33M has an identical shape of the concave bearing portion 13M in Embodiment 1. The third bearing part 34M is in a circular arc shape, being concentric with the concave bearing portion 33M. A bolt-hole 37 is formed in the connecting part 35, penetrating vertically there through.

Four bearing bodies 31F, 31M, and 31R are mounted on the top surface of the cylinder head 40 such that they are aligned anteroposteriorly. These four bearing bodies 31F, 31M, and 31R are mounted such that the first bearing hole 33F, the second bearing hole 33R, and the concave bearing portion 33M are concentrically aligned.

The bearing bodies 31F, 31M, and 31R are mounted with a bolt (not shown) inserted into the bolt-hole 37, then screwed into a female screw hole 41 in the cylinder head 40.

In the connecting part 35, a projecting portion 38 which is projecting downwards is formed. The bottom surface of the projecting portion 38 is contacting with the top surface of a receiving portion 42 in the cylinder head 40. The above-mentioned female screw hole 41 is formed in the receiving portion 42.

A positioning groove 43 opening upward is formed in the upper end of the cylinder head 40. The ear 36 is fitting into the positioning groove 43 with its anteroposterior movement restricted.

As mentioned above, the bearing bodies 31, 31M, and 31R are mounted to the cylinder head 40 with only a bolt. Also, the both right and left ends of the bearing bodies 31F, 31M, and 31R are merely placed onto the top surface of the cylinder head 40. Thus, the connecting part 35 might be deformed when a reaction force from the engine valve not shown affected the cam lobe 22.

To combat this, in the present Embodiment 2, reinforcing members 50F, 50M, and 50R made of a metallic material (e.g. iron and steel) having rigidity higher than those of the bearing bodies 31F, 31M, and 31R are embedded inside of the connecting part 35. The reinforcing members 50F, 50M, and 50R are embedded when the bearing bodies 31F, 31M and 31R are in the process of metallic casting.

The connecting part 35 includes a bolted part, as well as a part extending from the bolted part into both the left and the right sides and continuing to the bearing parts 34F, 34M, and 34R. The reinforcing members 50F, 50M, and 50R are embedded in this connecting part 35. This enables increase of the rigidity of the connecting part 35, preventing deformation and curvature of the connecting part 35 caused from the reaction force, which is coming from lower side and affecting the cam lobe 22.

Consequently, since there is no need for the both ends of the bearing bodies 31F, 31M, and 31R to be fixed to the cylinder head 40 by bolting, reducing the width of the ear 36 (size in the left and right direction) is possible. Reducing the width of the ear 36 enables downsizing of the bearing bodies 31F, 31M and 31R in width (size in the left and right direction). As a result, it is possible to downsize the supporting member 30 in width.

In the present embodiment, an example in which the reinforcing members 50F, 50M, and 50R are not exposed on the outer surface of the bearing bodies 31F, 31M and 31R is disclosed, however, a part of the reinforcing members 50F, 50M, and 50R may be exposed on the outer surface of the bearing bodies 31F, 31M, and 31R.

In the reinforcing members 50F, 50M, and 50R, a continuous hole 51 which is coaxial with the bolt-hole 37 and having the same diameter as the same is formed. Therefore, no trouble occurs when a bolt is inserted into the bolt hole 37.

Furthermore, in the present embodiment, an example in which the bearing bodies 31F, 31M and 31R are respectively fixed alone to cylinder head 40 is disclosed, however, the bearing bodies 31F, 31M and 31R may be connected each other with members other than the cylinder head 40.

Other Embodiments

With embodiments of the present invention described above with reference to the accompanying drawings, it is to be understood that the invention is not limited to those precise embodiments, and the embodiments as below, for example, can be within the scope of the present invention.

(1) The shape of the concave bearing portion is not limited to a semicircular shape. For example, it may be in a circular arc shape having either a longer or shorter circumference than that of a semicircle.

(2) The same number of cam lobes are not necessarily required to be respectively arranged in each of the areas: between the front frame and the middle frame, between the front and the rear middle frames, and between the middle frame and the rear frame. Each of these areas may have a different number of cam lobes.

(3) The number of the concave bearing portions supporting one camshaft may be one or three or more.

(4) Though the example, in which the area surrounded by the front frame and the rear frame are divided with the middle frames into three areas, and moreover, each of those three areas has cam lobes arranged therein, is shown above, the number of these areas may be two or less, or four or more.

(5) The number of cam lobes possible to be mounted to one shaft body may be five or less, or seven or more.

(6) The number of camshafts possible to be mounted to one supporting member may be one, or three or more.

What is claimed is:

1. A structure including a camshaft supported in a supporting member, wherein said camshaft comprises:

a shaft body of circular cross section;

a plurality of substantially oval-shaped cam lobes provided on a circumference of said shaft body; and a large-diameter part provided on the circumference of said shaft body, said large-diameter part being disposed between a plurality of said cam lobes and being concentric with said shaft body, wherein said large-diameter part has an external diameter which is the same size as or larger than that of a cam base in said cam lobe, wherein said supporting member comprises:

a pair of bearing holes for rotatably supporting both ends of said shaft body provided therein;

a first bearing hole of said pair of bearing holes having a circular shape of a size which allows said cam lobe to penetrate there through and having an internal diameter which is larger than an internal diameter of a second bearing hole of said pair of bearing holes such that said internal diameter of said second bearing hole will not allow said cam lobe to penetrate therethrough; and a concave bearing portion having an arc shape, said concave bearing portion being provided in said supporting member so as to support a pressing load supplied from the side of a valve onto said cam lobe, and wherein said large-diameter part of said cam is rotatably disposed in said concave bearing portion of said supporting member.

2. The structure of claim 1, wherein said concave bearing portion has a semi-circular arc shape for accepting said large diameter portion therein.

3. The structure of claim 1, wherein said concave bearing portion has a semi-circular arc shape which opens toward said camshaft for accepting said large diameter portion therein.

4. The structure of claim 1, wherein said internal diameter of said second bearing hole is smaller than said cam base of said cam lobe.

5. The structure of claim 1, wherein a radius of curvature of said concave bearing portion is smaller than a radius of curvature of said first bearing hole.

6. The structure of claim 1, wherein a portion of said support structure circumscribing said first bearing hole is formed of a single integral piece such that said camshaft is insertable in said support structure only by passing through said first bearing hole.

7. The structure of claim 1, wherein a dimension measured from a center of said shaft body to a distal end of said cam lobe is larger than a radius of curvature of said concave bearing portion.

8. A supporting member for supporting a camshaft, wherein said camshaft comprises a shaft body of circular cross section, a plurality of substantially oval-shaped cam lobes provided on a circumference of said shaft body, and a large-diameter part provided on the circumference of said shaft body, said large-diameter part being disposed between a plurality of said cam lobes and being concentric with said shaft body, wherein said large-diameter part has an external diameter which is the same size as or larger than that of a cam base in said cam lobe;

said supporting member comprising:

a pair of bearing holes for rotatably supporting both ends of said shaft body provided therein;

a first bearing hole of said pair of bearing holes having a circular shape of a size which allows said cam lobe to penetrate there through and having an internal diameter which is larger than an internal diameter of a second bearing hole of said pair of bearing holes such that said internal diameter of said second bearing hole will not allow said cam lobe to penetrate therethrough; and a concave bearing portion having an arc shape, said concave bearing portion being provided so as to support a pressing load supplied from the side of a valve onto said cam lobe, said concave bearing portion being configured to accept said large diameter portion such that said large diameter portion is rotatable therein.

9. The supporting member of claim 8, wherein said concave bearing portion has a semi-circular arc shape for accepting said large diameter portion therein.

10. The supporting member of claim 8, wherein said concave bearing portion has a semi-circular arc shape which opens toward said camshaft for accepting said large diameter portion therein.

11. The supporting member of claim 8, wherein said internal diameter of said second bearing hole is smaller than said cam base of said cam hole.

12. The supporting member of claim 8, wherein a radius of curvature of said concave bearing portion is smaller than a radius of curvature of said first bearing hole.

13. The supporting member of claim 8, wherein a portion of said support structure circumscribing said first bearing hole is formed of a single integral piece such that said camshaft is insertable in said support structure only by passing through said first bearing hole.

14. the supporting member of claim 8, wherein a dimension measured from a center of said shaft body to a distal end of said cam lobe is larger than a radius of curvature of said concave bearing portion.

* * * * *